United States Patent [19]

Gardner et al.

[11] Patent Number: 4,854,832

[45] Date of Patent: Aug. 8, 1989

[54] MECHANICAL SHIFT, PNEUMATIC ASSIST PILOT VALVE FOR DIAPHRAGM PUMP

[75] Inventors: Richard K. Gardner, Montpelier; p Nicholas Kozumplik, Jr., Bryan, both of Ohio

[73] Assignee: The Aro Corporation, Bryan, Ohio

[21] Appl. No.: 85,802

[22] Filed: Aug. 17, 1987

[51] Int. Cl.[4] ..... F04B 43/06

[52] U.S. Cl. ..... 417/393; 417/395; 91/313; 91/329

[58] Field of Search ..... 417/393, 395, 393; 91/313, 329, 411 R

[56] References Cited

U.S. PATENT DOCUMENTS

| | | | |
|---|---|---|---|
| 3,192,865 | 7/1965 | Klempay | 417/393 |
| 3,348,803 | 10/1967 | Churchill, Jr. | 91/313 |
| 3,782,863 | 1/1974 | Rupp | 417/393 |
| 3,791,768 | 2/1974 | Wanner | 417/393 |
| 4,104,008 | 8/1978 | Hoffman et al. | 91/313 |
| 4,247,264 | 1/1981 | Wilden | 417/393 |
| 4,478,560 | 10/1984 | Rupp | 417/393 |
| 4,548,551 | 10/1985 | Ruttenberg et al. | 417/393 |

FOREIGN PATENT DOCUMENTS

| | | |
|---|---|---|
| 505473 | 12/1954 | Italy . |
| 524055 | 7/1940 | United Kingdom . |

*Primary Examiner*—Leonard E. Smith
*Assistant Examiner*—Leonard P. Walnoha
*Attorney, Agent, or Firm*—Allegretti & Witcoff, Ltd.

[57] ABSTRACT

Briefly, the present invention comprises a combined mechanical shifting mechanism and pneumatic pilot valve construction to contrl the cycling of a double diaphragm pump. The mechanical cycling or shifting mechanism is positioned between pressure chambers of the diaphragm pump in the pump housing and extends axially into one or the other pressure chamber. The shifting mechanism moves axially in response to engagement by one of the pump diaphragms. Upon engagement by a diaphragm, the mechanical shift opens fluid pressure passageways to a pneumatic pilot valve which controls fluid flow to the respective pressure chambers associated with the diaphragm pump. A positive pilot signal is thus supplied through the entire stroke or cycle of the diaphragm pump. The mechanicl shifting mechanism is not connected directly to a diaphragm or to the connecting rod which connects the diaphragms.

4 Claims, 3 Drawing Sheets

MECHANICAL SHIFT, PNEUMATIC ASSIST PILOT VALVE FOR DIAPHRAGM PUMP

BACKGROUND OF THE INVENTION

This invention relates to an improved fluid operated, double diaphragm pump, and, more particularly, to the pilot valve construction for such a pump.

Heretofore the use of a double diaphragm pump to transfer highly viscous liquids has been known. Typically such a pump comprises a pair of pumping chambers with a pressure chamber arranged in parallel with each pumping chamber in a housing. Each pressure chamber is separated from its associated pumping chamber by a flexible diaphragm. As one pressure chamber is pressurized, it forces the diaphragm to compress fluid in the associate pumping chamber. The fluid is thus forced from the pumping chamber. Simultaneously, the diaphragm associated with the second pumping chamber is flexed so as to draw fluid material into the second pumping chamber. The diaphragms are reciprocated in unison in order to alternately fill and evacuate the pumping chambers. In practice, the chambers are all aligned so that the diaphragms can reciprocate axially in unison. In this manner the diaphragms may also be mechanically interconnected to ensure uniform operation and performance by the double acting diaphragm pump.

Various controls have been proposed for providing pressurized fluid to the chambers associated with the double acting diaphragm pump. It is important to provide some type of pilot valve arrangement which will shift the flow of pressurized fluid to the appropriate pressure chamber. Most previous diaphragm pump pilot valve designs produce a momentary signal at the end of each pumping stroke to effect the shift of fluid flow. That momentary signal is typically removed by reversal of movement of the diaphragms.

When pumps are operated at a very slow cycle speed or pumping very heavy or viscous material, the over travel of the diaphragm is reduced. The duration of the pilot or shift signal is also shortened. This may cause only partial shifting of the pilot valve or stopping of the pilot valve in a center position thereby incapacitating the pump. The present invention is designed to overcome this deficiency associated with prior art designs.

SUMMARY OF THE INVENTION

Briefly, the present invention comprises a combined mechanical shifting mechanism and pneumatic pilot valve construction to control the cycling of a double diaphragm pump. The mechanical cycling or shifting mechanism is positioned between pressure chambers of the diaphragm pump in the pump housing and extends axially into one or the other pressure chamber. The shifting mechanism moves axially in response to engagement by one of the pump diaphragms. Upon engagement by a diaphragm, the mechanical shift opens fluid pressure passageways to a pneumatic pilot valve which controls fluid flow to the respective pressure chambers associated with the diaphragm pump. A positive pilot signal is thus supplied through the entire stroke or cycle of the diaphragm pump. The mechanical shifting mechanism is not connected directly to a diaphragm or to the connecting rod which connects the diaphragms.

Thus, it is an object of the invention to provide an improved pilot valve construction for a diaphragm pump.

A further object of the invention is to provide an improved combined mechanical shifting mechanism and pneumatic pilot valve construction for a diaphragm pump.

Yet another object of the invention is to provide an improved combined mechanical shifting mechanism and pneumatic pilot valve construction for a diaphragm pump wherein the pilot signal is supplied throughout the entire cycle of the apparatus.

Yet a further object of the invention is to provide an improved mechanical shifting mechanism and pneumatically operated pilot valve assembly for use in a double diaphragm pump having a simplified construction, efficient design, and of improved reliability.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
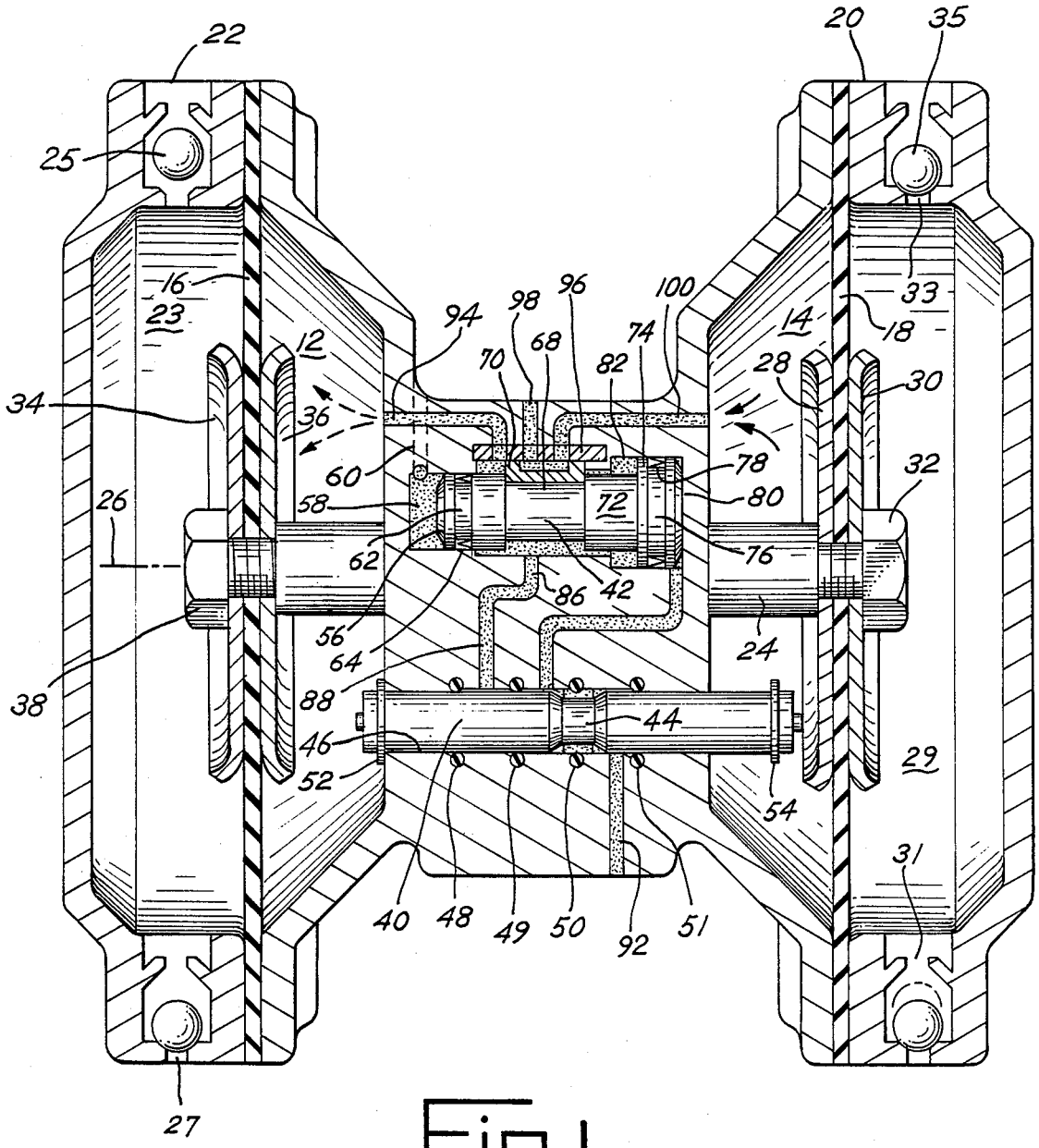
FIG. 1 is a schematic cross sectional view of the pilot valve construction of the invention as incorporated in a double diaphragm pump in a first position.
Figure 2:
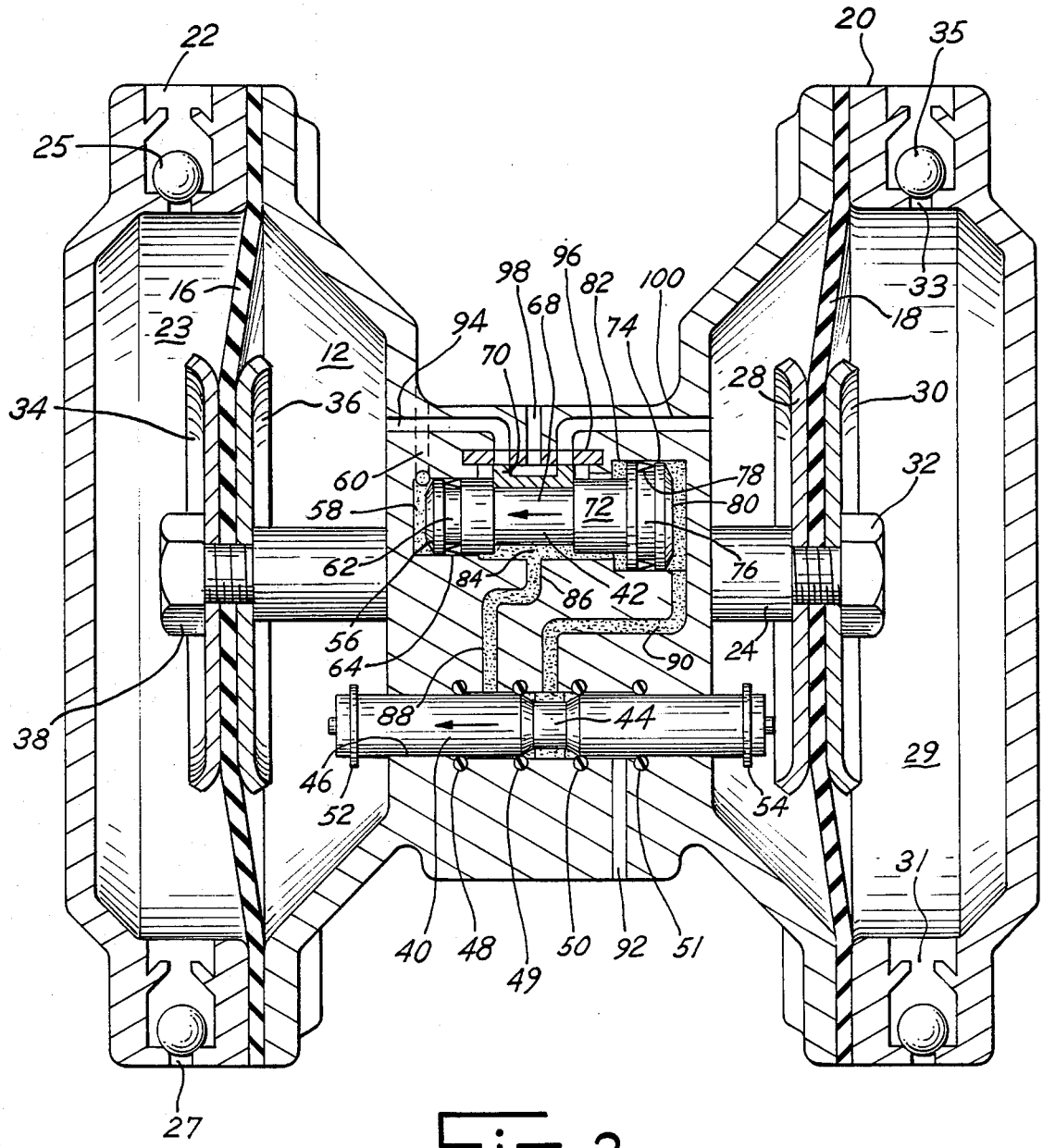
FIG. 2 is a cross sectional view similar to FIG. 1 wherein the pump has moved to a next sequential position.
Figure 3:
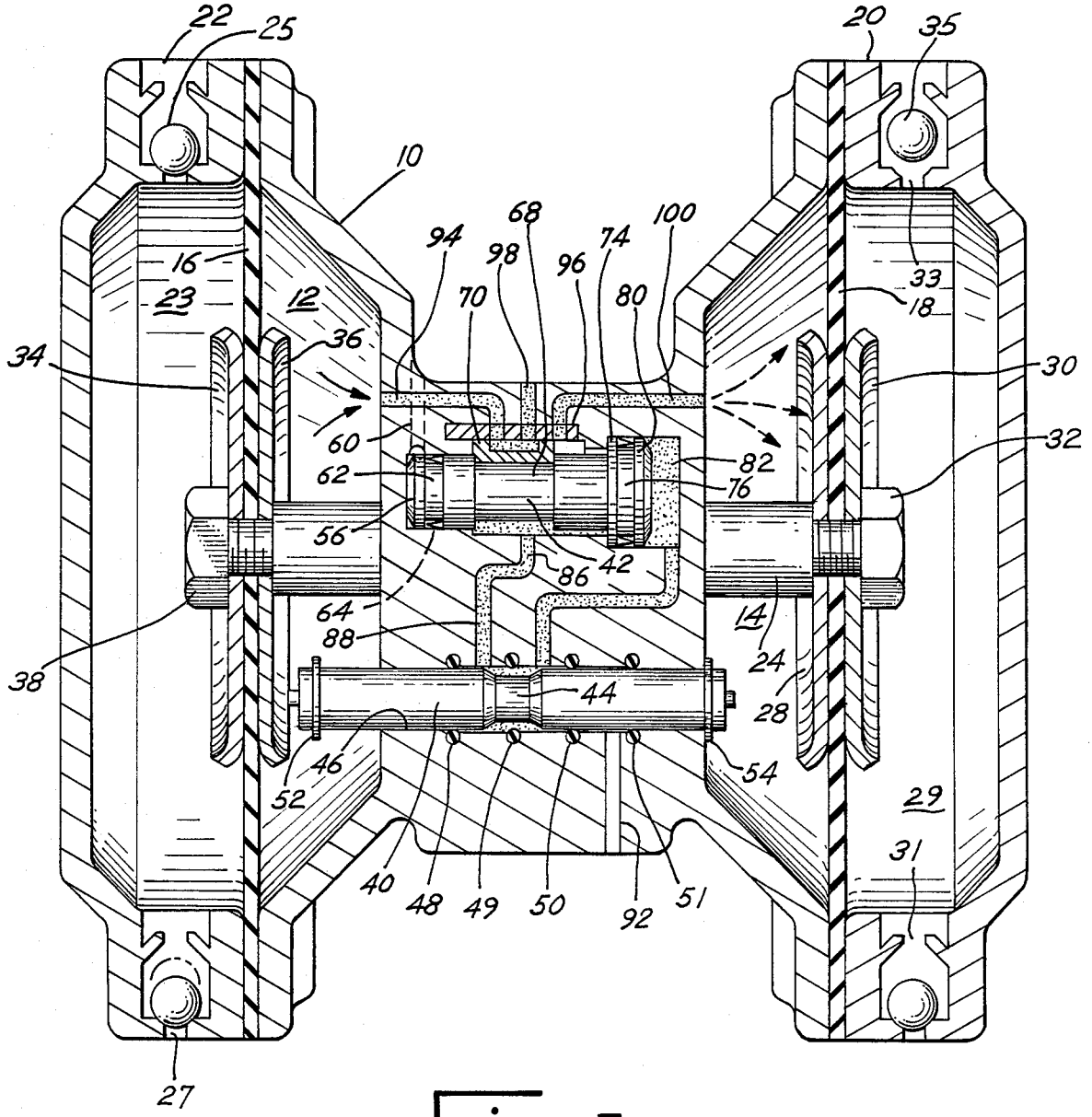
FIG. 3 is similar to FIG. 2 and illustrates further movement and shifting of the pilot valve construction and shifting of the pump to the next sequential position.

The drawings illustrate a typical double diaphragm pump incorporating the mechanical shift, pneumatic assist pilot valve construction of the present invention. FIGS. 1, 2 and 3 illustrate sequential operation of that pump. Like numbers refer to like parts in each of the figures.

Thus, the pump includes a main housing 10 which defines first and second opposed axially spaced pressure chambers 12 and 14 which are substantially identical in size, shape and volume. The chambers 12 and 14 are generally conical in shape. Thus, as depicted in the cross section of FIG. 1, the cross sectional configuration for those chambers 12, 14 will generally be the same regardless of the section taken.

Associated with each chamber 12 and 14 is a flexible diaphragm 16 and 18 respectively. The diaphragms 16 and 18 ar generally circular in shape and are held in position in sealing relationship with the housing 10 by an associated enclosure member 20 and 22 respectively. Thus, as depicted on the right hand side of FIG. 1, housing 10, diaphragm 18 and member 20 define a pressure chamber 14 and a pump chamber 29. Similarly, as depicted on the left side of FIG. 1, housing 10, diaphragm 16 and member 22 define a pressure chamber 12 and a pump chamber 23.

Each of the diaphragms 16 and 18 is fashioned from an elastomeric material as is known to those skilled in the art. The diaphragms 16 and 18 are connected mechanically by means of a shaft 24 which extends axially along an axis 26 through the midpoint of each of the diaphragms 16 and 18. The shaft 24 is attached to the diaphragm 18 by means of opposed plates 28 and 30 on opposite sides thereof retained in position by a bolt 32 in shaft 24. With respect to diaphragm 16, plates 34 and 36 are retained by a bolt 38 threaded into the shaft 24. Thus, the diaphragms 16 and 18 will move axially in unison as the pump operates.

During operation the chamber 12 will initially be pressurized and the chamber 14 will be connected with an exhaust. This will cause the diaphragm 16 to move to the left in FIG. 1 thereby compressing fluid within a fluid chamber 23 forcing that fluid outwardly through a check valve 25. A second check valve 27 at the opposite end of chamber 23 is closed by this pumping action. Simultaneously as the diaphragm 16 moves to the left in FIG. 1, the diaphragm 18 will also move to the left. Pressurized fluid from the chamber 14 will exhaust. At that same time the fluid being pumping will enter chamber 29 through check valve 31. A second check valve 33 will be closed during this operation.

Movement of the shaft 24 in the reverse direction or to the right of FIG. 1 will reverse the pumping and filling operations of the chambers 23 and 29. In any event, flow is effected through the outlet 25 or outlet 35. Fluid flow into the pump is effected through the inlet 27 or the inlet 31.

The specific structure of the present invention relates to the construction of the mechanical and fluid operated pilot valve construction which controls flow of pressurized fluid to the chambers 12 and 14 and thus controls the driving of the double diaphragm pump.

Referring therefore first to FIG. 1, the pilot construction includes an axially slidable mechanical pilot member or shift rod 40 and a pneumatically operated actuator 42. In the embodiment shown, the actuator 42 is also axially displaceable though the direction of movement of the valve 42 relative to the diaphragms 16, 18 is not a limiting feature of the invention.

Referring to the mechanical pilot member 40, the member 40 is a generally cylindrical rod which projects through the housing 10 into the chambers 12 and 14. As shown in FIG. 1, the length of the member 40 is less than the length of the shaft 24 extending between the diaphragms 16 and 18. The member 40 includes a reduced diameter, annular groove 44 at approximately the midpoint from the ends of the member 40. The member 40 slides in a cylindrical passage 46 defined through the housing 10 with a series of O-rings 48, 49, 50 and 51 inserted in grooves within the cylindrical opening 46 and sealingly engaged against the member 40. Passages intermediate the O-rings 48, 49, 50 an 51 thus are sealed and separate from one another so that there will be no fluid leakage therebetween. At opposite ends of the member 40, a circumferential washer 52 and 54 is retained within a groove. The washers 52 and 54 serve to limit the travel of the member 40 as it slides within the cylindrical passage 46 in response to engagement by plate 28 or plate 36 as the case may be as well as in response to air pressure as will be described below.

The actuator 42 is a generally cylindrical valve member having a series of different diameters so as to provide for actuation in response to pressure differential. Thus, the actuator 42 includes a first end surface 56 positioned within a constant diameter chamber 58. Chamber 58 is connected by passage 60 to the atmosphere. Actuator 42 includes an annular groove 62 with a seal 64 engaging against the walls of chamber 58. The diameter of the chamber 58 is substantially the same as the diameter of the first end section 66 of actuator 42. Actuator 42 also includes an annular groove 68 which receives a sliding D-valve 70. Actuator 42 includes a neck 72 having the same diameter as the section 66 and connected with an expanded diameter head 74 having an annular groove 76 which receives a seal 78. The end surface 80 of the actuator 42 defines a surface area which is an active surface as will be explained below. The diameter of the head 74 is substantially equal to the enlarged diameter of the chamber 82 within which the head 74 slides. The chamber 82 limits the travel permitted by the head 74 and thus limits the travel of the actuator 42. The diameter of the chamber 82 is greater than the diameter of the next adjacent chamber 84 in the center between the chambers 58 and 82. A fluid pressure inlet 86 connects to the chamber 84 and provides fluid pressure which operates the double acting diaphragm pump.

A passage 88 leads from the inlet 86 to the passage 46 intermediate O-rings 48 and 49. A passage 90 connects between the forward end of chamber 82 and intermediate the O-rings 49 and 50 to the passage 46. A passage 92 connects between O-rings 50 and 51 from passage 46 to the atmosphere. The chamber 12 is connected by a passage 94 to the chamber 84 through a manifold plate 96. The passage 98 connects from the atmosphere to the chamber 84. The chamber 14 connects through the passage 100 to the chamber 84 again through the plate 96. Of course, the D-valve or slide valve 70 is constructed so as to connect only two of the passages defined through the plate 96. Thus, the D-valve 70 provides connection of passages 98 and 100 or 98 and 94 depending upon the position of the actuator 42. The spacing and position of the D-valve 70 and the construction of the actuator 42 and the relative positions of all the passages described as such as to be consistent with the operation of the device as will be described below.

In operation, reference is first directed to FIG. 1. Air enters through the port 86 pressurizing passage 88 and also pressurizing the chamber 84 as well as a part of the chamber 82. With the actuator 42 in the position shown in FIG. 1, the face 80 or surface area 80 of the head 74 is in communication to exhaust through passage 90 annular groove 44 and passage 92. At this same instant, the chamber 12 is connected through passage 94 to the chamber 84 and thus to a pressurized source of fluid. Simultaneously, because of the position of the valve 70, the chamber 14 connects through passage 100 and passage 98 to the atmosphere or exhaust. Thus, air pressure acting on the diaphragm 16 causes the diaphragm 16 to move to the left in FIG. 1. The shaft 24 likewise moves to the left as does the diaphragm 18. Driving fluid, i.e. air, of course, exhausts from the chamber 14. Pumped fluid is drawn into the chamber 29. Fluid is pumped from the chamber 23.

The actuator 42 is held in the position illustrated in FIG. 1 due to the fact that the pressure in the chamber 84 acts against the back side of the head 74. The forward side or front surface 80 is connected with the atmosphere. Thus, the actuator 42 is constantly maintained in the position shown in FIG. 1 during the pressurization of the chamber 12. Pressure within the chamber 12 also acts on the surface or face of the member 40 projecting into chamber 12 forcing chamber 12 to the extreme right in FIG. 1. The ring 52 holds the member 40 and prevents it from passing through the cylinder 46. The pressure on the face of the member 40 is sufficient to overcome the frictionally engagement of the O-rings 48, 49, 50 and 51. The air pressure on the seals such as seals 64 and 78 prevents leakage of air into the chambers at the end of the member 42. Chamber 58 connects to the atmosphere or exhaust via passage 60.

As the diaphragms 16 and 18 move to the left, movement of the member 40 is effected due to engagement of plate 28 therewith. As the diaphragm 18 moves to the left in FIG. 1, it will eventually engage against the member 40 and more particularly against the head of the member 40 forcing that member 40 to the left.

Thus, turning to FIG. 2, it will be seen that the member 40 is transferred to the left mechanically. Upon such transfer, the exhaust passage 90 is closed. Further movement to the left connects the passage 88 with the passage 90 as shown in FIG. 3. Pressurized fluid or air then flows into the chamber 82 against the surface 80 driving the valve due to differential surface area to the left as depicted in FIG. 3. The D-valve insert 70 is translated axially as shown in FIG. 3 so as to connect passages 94 and 98. Chamber 12 is then connected to exhaust and chamber 14 is connected to pressurized air from inlet 86 through chamber 84 and passage 100 connecting through plate 96. Again, air from the chamber 58 is vented via passage 60.

As the chamber or cavity 14 is pressurized, pressure within the chamber acts against the right hand end of the member 40 maintaining that member in the position shown in FIG. 3. This ensures that pressure is maintained against the end 80 of the valve 42. This, in turn, ensures that pressurized air is provided through passage 100 and that exhaust is continuously permitted from chamber 12 through passage 94. The diaphragm 18, as well as the diaphragm 14 and the shaft 24, then move to the right in FIG. 3 effecting pumping from chamber 29 and drawing fluid into the chamber 23.

The movement of the plate 36 to the right in FIG. 3 will ultimately engage that plate with the end of the member 40 thereby again effecting a reversal of operation of the pump. The member 40 will thus ultimately be transferred back to the position shown in FIG. 1 again effecting movement to the left of the diaphragms 16, 18 and shaft 24. The pump will continue to oscillate or cycle as long as air is supplied through the inlet port 86.

With the construction of the present invention, a positive pressure is always provided to the actuator 42 until that actuator 42 is actually shifted. Then positive pressure is applied to the actuator 42 in its shifted position. The mechanical member 40 thus provides for constant and positive shifting of the pilot valve mechanism. Because the ends of the member 40 are pressurized by fluid pressure, the pilot valve configuration maintains positive pressure even after mechanical initiation of the change in cycle has been terminated.

There has been set forth a preferred embodiment of the invention. However, the invention may be altered or changed without departing from the spirit or scope thereof. The invention, therefore, is to be limited only by the following claims and their equivalents.

What is claimed is:

1. A combination mechanical and fluid operated pilot valve construction for a double diaphragm pump comprising, in combination:

a housing defining an axis with first and second axially spaced fluid pressure chambers in a double diaphragm pump;

first and second diaphragms arranged in the first and second pressure chambers, respectively, to define a flexible wall in each of said pressure chambers, said diaphragms generally transverse to the axis, said diaphragms mechanically connected for generally simultaneous, reciprocal movement in the axial direction, said diaphragms each also defining a flexible wall of an adjacent pumping chamber; and a pilot valve assembly having a single fluid inlet, a first outlet to the first chamber and a second outlet to the second chamber, said pilot valve assembly also including a fluid operated slide valve reciprocal to connect the inlet to the first or second outlets; said fluid operated slide valve including a differential surface area fluid actuator having a minor and a major surface area; said assembly also including a mechanically shiftable pilot member projecting axially into the pressure chambers and slidable axially in response to engagement by one of the diaphragms said slide valve and actuator comprising an elongate spool valve translatable axially in the housing, said spool valve including a slide member along one side, said slide member cooperative with the first or second outlets and an intermediate exhaust passage whereby only one or the other outlet is connected to the exhaust passage as the other or one outlet is connected to a pressurized fluid inlet;

first and second fluid pressure passage to the fluid actuator minor and major surface areas, respectively, said first pressure passage communicating directly with the minor surface area, and the second pressure passage communicating through the mechanically shiftable pilot member to the major surface area; and said mechanically shiftable pilot member including a fluid connection passage which interconnects, the first and second pressure passages to provide pressurized fluid flow into the second pressure passage upon mechanical shifting of the pilot member the other diaphragm.

2. The combination of claim 1 wherein the pilot member projecting into the pressure chamber defines a surface area against which pressurized fluid in the chamber is active to bias the pilot member.

3. The combination of claim 1 wherein the mechanically shiftable pilot member includes a stop member to limit axial travel.

4. The combination of claim 1 including an exhaust passage connectable to the major surface area through the mechanically shiftable pilot member by axial translation of the pilot member.

* * * * *

UNITED STATES PATENT AND TRADEMARK OFFICE

CERTIFICATE OF CORRECTION

PATENT NO. : 4,854,832

DATED : August 8, 1989

INVENTOR(S) : Richard K. Gardner and Nicholas Kozumplik, Jr.

It is certified that error appears in the above-identified patent and that said Letters Patent is hereby corrected as shown below:

In Claim 1, Column 6, line 46, change "the pilot member the" to -- the pilot member axially toward only one of the diaphragms by engagement with the --

Signed and Sealed this

Thirty-first Day of December, 1991

*Attest:*

HARRY F. MANBECK, JR.

*Attesting Officer*

*Commissioner of Patents and Trademarks*